US005632444A

United States Patent [19]

Camplin et al.

[11] Patent Number: 5,632,444

[45] Date of Patent: May 27, 1997

[54] FUEL INJECTION RATE SHAPING APPARATUS FOR A UNIT INJECTOR

[75] Inventors: Fred A. Camplin, Peoria; Michael A. Flinn, East Peoria; Lianghe Zuo, Normal, all of Ill.

[73] Assignee: Caterpillar Inc., Peoria, Ill.

[21] Appl. No.: 421,645

[22] Filed: Apr. 13, 1995

[51] Int. Cl.[6] ..... F02M 47/02

[52] U.S. Cl. ..... 239/88; 239/90; 239/533.1; 239/533.3; 92/52

[58] Field of Search ..... 239/88, 90–92, 239/96, 533.1, 533.3, 533.9, 585.1, 126; 92/52, 113–115, 255, 288, 259; 91/519

[56] References Cited

U.S. PATENT DOCUMENTS

| | | | |
|---|---|---|---|
| 2,792,687 | 5/1957 | Snell | 60/54.6 |
| 3,021,802 | 2/1962 | Glas | 92/52 |
| 3,209,737 | 10/1965 | Omotehara et al. | 123/90 |
| 3,269,275 | 8/1966 | Waite | 92/52 |
| 3,269,462 | 8/1966 | Voetter | 166/100 |
| 3,312,171 | 4/1967 | Cary | 92/52 |
| 3,689,205 | 9/1972 | Links | 417/401 |
| 4,054,248 | 10/1977 | Beardmore | 239/88 |
| 4,281,792 | 8/1981 | Sisson et al. | 239/5 |
| 4,327,694 | 5/1982 | Henson et al. | 123/500 |
| 4,392,612 | 7/1983 | Deckard et al. | 239/88 |
| 4,437,443 | 3/1984 | Hofbauer | 123/446 |
| 4,457,212 | 7/1984 | Unger et al. | 92/52 |
| 4,527,738 | 7/1985 | Martin | 239/90 |
| 4,567,811 | 2/1986 | Piegza et al. | 92/52 |
| 4,811,899 | 3/1989 | Egler | 239/15 |
| 5,033,442 | 7/1991 | Perr et al. | 123/502 |
| 5,094,397 | 3/1992 | Peters et al. | 239/88 |
| 5,121,730 | 6/1992 | Ausman et al. | 123/467 |
| 5,143,291 | 9/1992 | Grinsteiner | 239/88 |
| 5,271,371 | 12/1993 | Meints et al. | 123/446 |
| 5,566,660 | 10/1996 | Camplin et al. | 123/496 |

FOREIGN PATENT DOCUMENTS

| | | |
|---|---|---|
| 0195736 | 9/1986 | European Pat. Off. . |
| 814513 | 2/1936 | France . |
| 4406695 | 8/1994 | Germany . |
| 1043383 | 9/1966 | United Kingdom . |
| 2213873 | 8/1989 | United Kingdom . |

*Primary Examiner*—Andres Kashnikow
*Assistant Examiner*—Lisa Ann Douglas
*Attorney, Agent, or Firm*—Mark D. Becker

[57] ABSTRACT

A multipiece fuel pump plunger assembly for controlling the fuel injection rate and delivery during the initial injection portion of a fuel injection cycle for an internal combustion engine. The injector includes a two piece plunger assembly including a plunger and a plunger sleeve. The plunger having a small predetermined diameter and being slidably positioned within a plunger sleeve having a diameter greater than the diameter of the plunger. The multipiece plunger is advantageous because it allows for shaping of the rate of fuel injected into the combustion process thereby reducing the excess fuel flow in the early portion of the injection cycle. Elimination of the excess fuel flow results in lower oxides of nitrogen and particulate exhaust emission levels and less engine noise.

12 Claims, 3 Drawing Sheets

FUEL INJECTION RATE SHAPING APPARATUS FOR A UNIT INJECTOR

TECHNICAL FIELD

The present invention relates to fluid unit injectors and more particularly to fuel injection rate shaping for hydraulically-acuatated electronically controlled unit injectors.

BACKGROUND ART

Engine exhaust emission regulations are becoming increasingly restrictive. One way in which the stricter emission standards can be met is to tailor the rate, or rate-shape the quantity and timing of the fuel injected into the combustion chamber to match the engine cycle. The ability to match the desired fuel/air ratio can result in reduced levels of particulate and oxides of nitrogen in the engine exhaust.

A second problem which rate-shaping improves is engine noise. By injecting the fuel slower during the early phase of the combustion process, combustion is less harsh which results in less engine noise. The present invention is directed to overcome one or more of the problems as set forth above.

DISCLOSURE OF THE INVENTION

In one aspect of the present invention, a fluid unit injector rate shaping apparatus is disclosed. The apparatus includes a housing having a longitudinal bore and a plunger sleeve having a longitudinal extending bore. The plunger sleeve is movable within and relative to the housing bore. The housing, the housing bore and the plunger sleeve define a fluid pump chamber. The plunger sleeve is movable a preselected distance into the pump chamber. A plunger is slidably positioned in the plunger sleeve bore and is movable a preselected distance into the pump chamber. The apparatus includes a first means of moving the plunger in a direction toward the fluid pump chamber and a second means of moving the plunger sleeve in a direction toward the fluid pump chamber during movement of the plunger.

In another aspect of the present invention, an apparatus is provided for injection rate shaping for a hydraulically-actuated fluid unit injector. The injector has an intensifier piston, a piston cavity, and a liquid chamber. Elements are positioned within the piston cavity and the liquid chamber and are actuatable by movement of the intensifier piston for exerting pressure on liquid in the liquid chamber. The elements include a plunger and a plunger sleeve. The plunger is moveable by the intensifier piston in a direction into the liquid chamber. The plunger sleeve is moveable into the liquid chamber in response to the intensifier piston and the plunger moving a preselected distance toward the liquid chamber.

In another aspect of the invention, an apparatus is provided for injection rate shaping for a hydraulically-actuated fluid unit injector. The injector has a barrel, an intensifier piston, a piston cavity, a plunger spring, a washer retainer, and a ring retainer. The intensifier piston has first and second end portions. The plunger spring is positioned within the piston cavity and interposed between the washer retainer and the barrel. Each of the barrel, the plunger spring and the washer retainer has a longitudinal central bore. The injector further includes a plunger sleeve which has a first end portion, a second end portion, a longitudinal extending bore, and a preselected length "$L_1$". The plunger sleeve has an outwardly extending stop positioned at the first end portion.

The plunger sleeve is slidably positioned in the central bore and moveable relative to the barrel, the plunger spring, and the intensifier piston. The injector also includes a plunger having a first end portion, a second end portion, and a preselected length "$L_2$" greater than the length "$L_1$" of the plunger sleeve. The plunger includes an outwardly extending stop positioned at the first end and is of a diameter suitable for insertion into the bore of the plunger sleeve. The plunger is slidably positioned in the bore of the plunger sleeve and is moveable relative to the barrel, the plunger sleeve, and the plunger spring. The apparatus includes a means of fixedly connecting the second end portion of the plunger to the washer retainer.

BEST MODE FOR CARRYING OUT THE INVENTION

Figure 1:
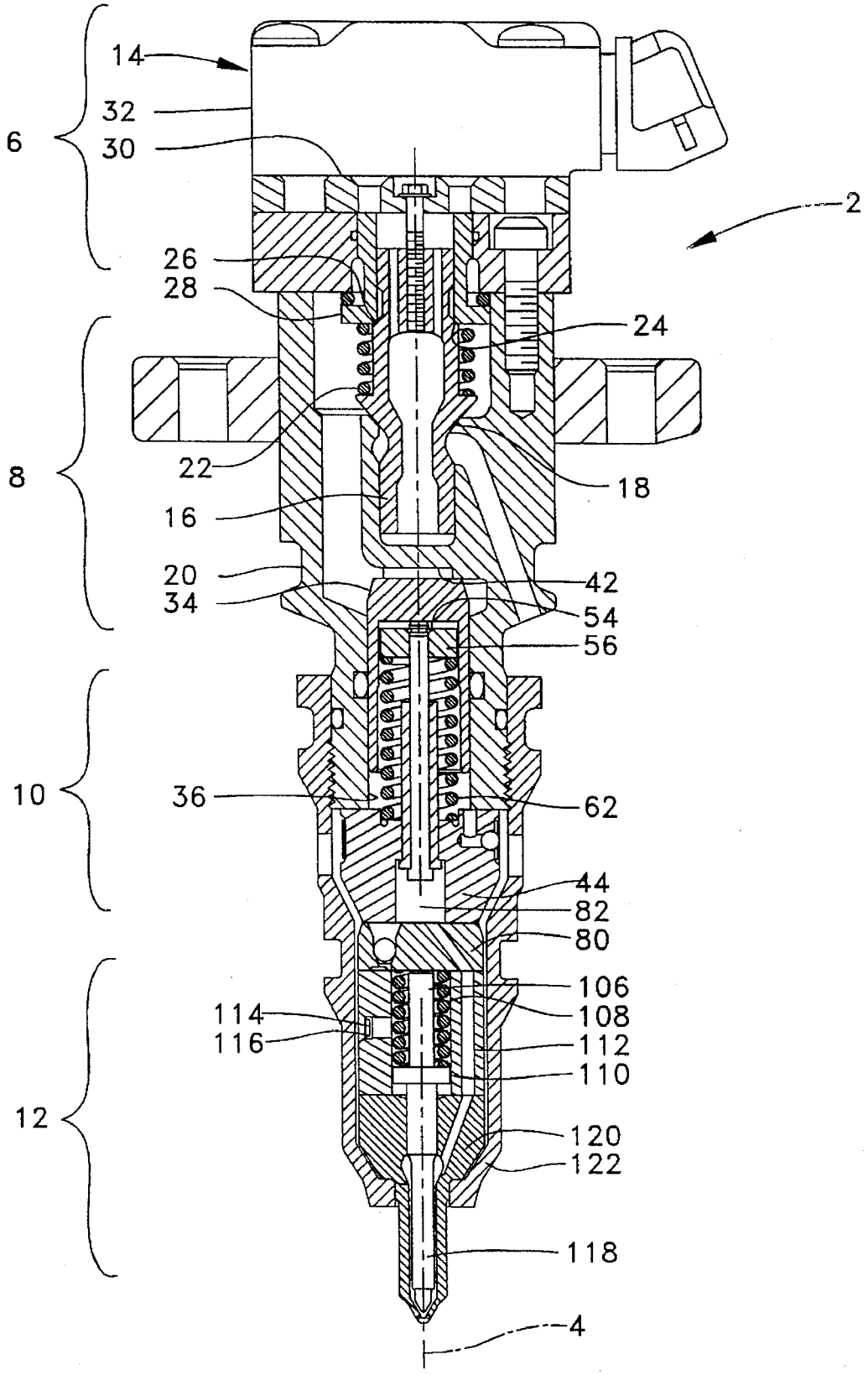
FIG. 1 is a longitudinal section of a hydraulically-actuated electronically controlled unit injector for an internal combustion engine.

The HEUI fuel injection system includes one or more hydraulically-actuated electronically controlled unit injectors. Referring to FIG. 1, each unit injector 2 has a longitudinal axis 4 and includes an actuator and valve assembly 6, a body assembly 8, a barrel assembly 10, and a nozzle and tip assembly 12.

The actuator and valve assembly 6 is provided as a means for selectively communicating either relatively-high pressure actuating fluid or relatively-low pressure damping fluid to each unit injector 2 in response to receiving an electronic control signal.

Figure 2:
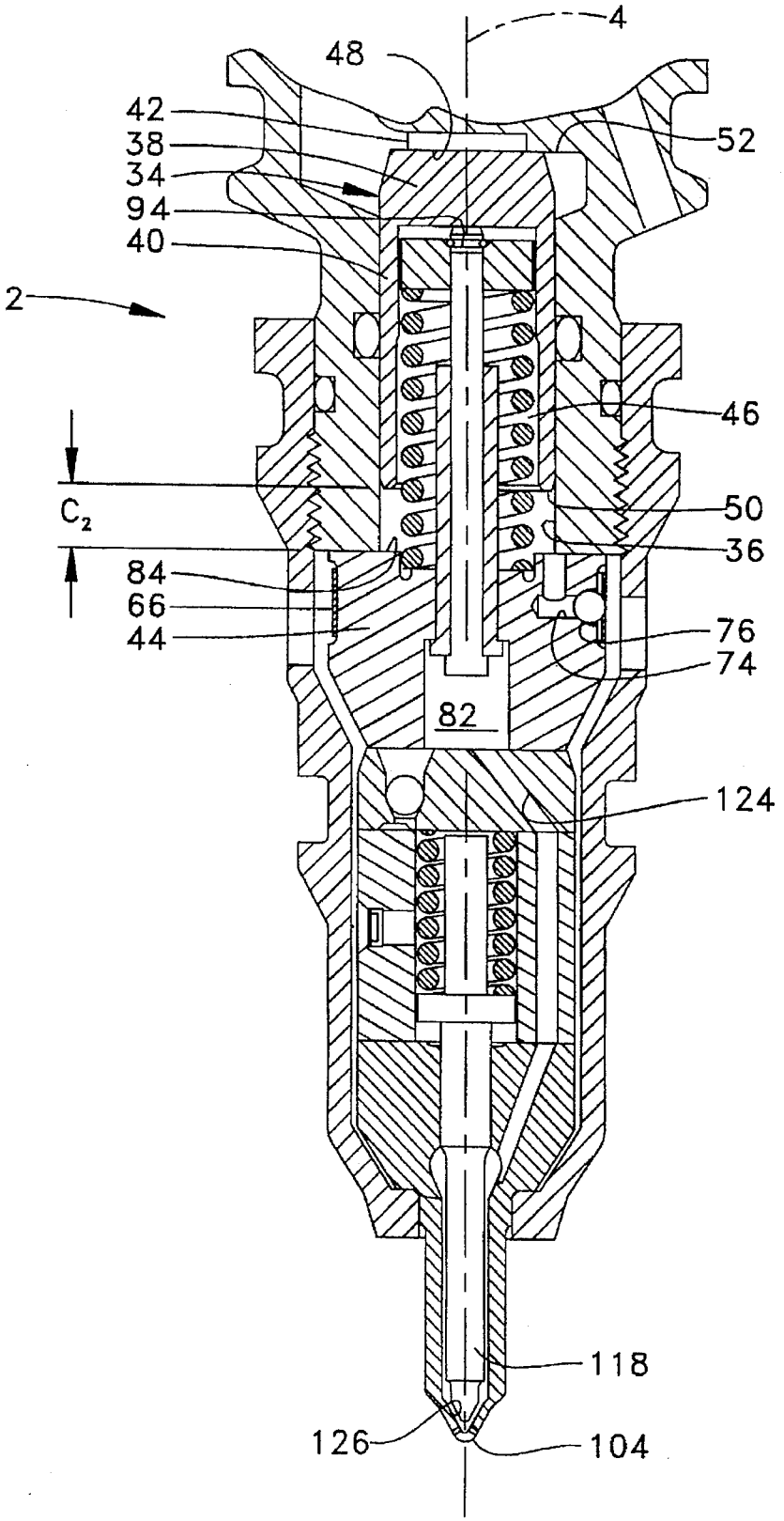
FIG. 2 is an enlarged longitudinal section of the lower portion of a hydraulically-actuated electronically controlled unit injector shown in FIG. 1.

Referring to FIGS. 1 and 2, the actuator and valve assembly 6 includes an actuator 14, preferably in the form of a solenoid assembly, and a valve 16, preferably in the form of a popper valve. The popper valve 16 is movable between first and second positions. The first position of the popper valve 16 is defined as the position at which the poppet valve lower seat 18 is normally seated on the body 20 due to the bias of the poppet spring 22. At the first position of the poppet valve 16, the poppet valve upper seat 24 is normally unseated from the annular seat 26 of the poppet sleeve 28 by a selected clearance.

When the solenoid assembly 14 is electrically energized, the armature 30 is magnetically attracted towards the stator 32 so that the popper valve 16 moves axially upward (according to the orientation shown in FIG. 1) towards the second position. The second position of the poppet valve 16 is defined as the position at which the upper seat 24 of the poppet valve 16 is seated against the annular seat 26 of the poppet sleeve 28. The lower seat 18 of the poppet valve 16 is unseated from the body 20. In this position high pressure actuating fluid is allowed to act upon the intensifier piston 34.

Figure 3:
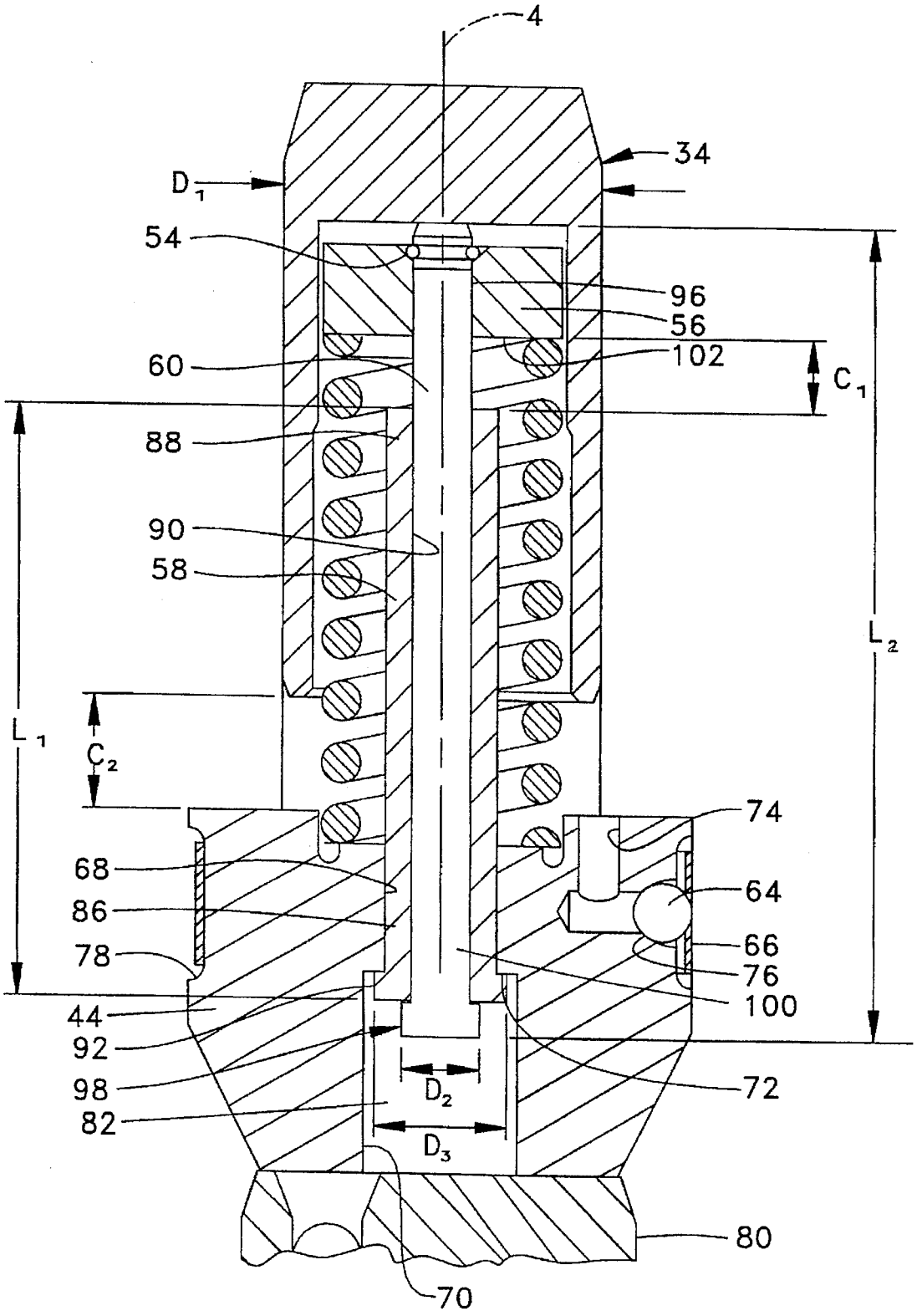
FIG. 3 is a diagrammatic enlarged partial view of the barrel assembly for the unit injector shown in FIGS. 1 and 2.

The body 20 is adapted to receive the poppet valve 16 and the barrel assembly 10. As shown in FIGS. 1 and 2, the intensifier piston 34 is slidably positioned in the second blind bore 36 of the body 20. As shown in FIGS. 2 and 3, the intensifier piston 34 is a generally cup-shaped cylinder having an outside diameter $D_1$ which corresponds to an effective cross-sectional pumping area $A_1$. The intensifier piston 34 has a crown portion 38, and a generally hollow cylindrical skirt portion 40. The crown portion 38 of the intensifier piston 34 and the second blind bore 36 of the body 20 collectively define an expandable and contractible piston pump chamber 42. The skirt portion 40 of the intensifier piston 34, the barrel 44 and the second blind bore 36 of the body 20 collectively define a contractible and expandable piston cavity 46. The intensifier piston 34 also has first and second stops, 48, 50 respectively, formed thereon. The first stop 48 is preferably located on a free end of the crown portion 38 and is adapted to engage and disengage the seat 52 of the body 20. The second stop 50 is preferably located on a free end of the skirt portion 40 and is adapted to engage and disengage abutment with the barrel 44.

As shown in FIGS. 1, 2, and 3 the barrel assembly 10 includes a barrel 44, a ring retainer 54, a washer retainer 56, a plunger sleeve 58, a plunger 60, a plunger spring 62, a one-way flow check valve 64 preferably in the form of a ball check, and an annular spring retainer 66.

As shown in FIGS. 2 and 3, the barrel 44 includes a precision-formed centrally-disposed longitudinally-extending main bore 68 with a corresponding centrally-disposed longitudinal precision counter-bore 70, the junction of which forms a barrel shoulder 72. The barrel further includes an outlet passage 74 communicating with the second blind bore 36 of the body 20. The outlet passage 74 includes an exit end portion having an annular seat 76 formed thereon. The barrel 44 also has an outer peripheral surface in which an annular peripheral groove 78 is formed.

The counter-bore 70 of the barrel 44, the plunger 60, the plunger sleeve 58, and the stop member 80 collectively define a fuel pump chamber 82.

One end portion of the barrel 44 facing the intensifier piston 34 serves as a barrel seat 84 for the second stop 50 of the intensifier piston 34. As shown in FIG. 3, a selected axial clearance $C_2$ is provided between the barrel seat 84 and the second stop 50 of the intensifier piston 34 in order to determine the maximum displacement or stroke of the intensifier piston 34.

As shown in FIG. 3, the plunger sleeve 58 has a first end portion 86 and a second end portion 88. The plunger sleeve 58 has a length "$L_1$" and further includes a longitudinal bore 90 which extends therethrough. The plunger sleeve 58 includes an outwardly extending stop 92 having a diameter $D_3$ and corresponding area $A_3$ positioned at the first end portion 86. As shown in FIG. 3, a selected axial clearance $C_1$ is provided between the washer retainer 56 and the second end portion 88 of the plunger sleeve 58 to define the stroke or displacement of the plunger 60 prior to engagement and movement of the plunger sleeve 58.

The plunger 60, having a preselected length "$L_2$", which is greater than plunger sleeve 58 length "$L_1$", is slidably positioned in the longitudinal bore 90 of the plunger sleeve 58 by a close tolerance fit. The washer retainer 56 is preferably connected to the plunger 60 by an interference fit. Moreover, the washer retainer 56 is fixed to the plunger 60 by the ring retainer 54. The retainer ring 54 is positioned in a circumferential groove 94 at the plunger second end portion 96 within the longitudinal bore of the washer retainer 56. The plunger 60 has an outwardly extending stop 98 with an outside diameter $D_2$ which corresponds to an effective cross-sectional pumping area $A_2$ at its first end portion 100. The diameter $D_3$ of the plunger sleeve 58 is larger than the diameter $D_2$ by a selected amount. This ratio can, of course, be varied to tailor injection characteristics to the needs of a particular engine.

The plunger spring 62 has a longitudinal central bore and is positioned generally concentrically around the plunger sleeve 58 and is interposed between the barrel 44 and the washer retainer 56. The plunger spring 62 is preferably a helical compression spring which biases the plunger 60, plunger sleeve 58, and intensifier piston 34 upwardly (according to the orientation of FIG. 1) against the seat 52 of the body 20.

In accordance with conventional practice, the nozzle and tip assembly 12 includes a stop member 80, a stop pin 106, a needle check spring 108, a lift spacer 110, a sleeve 112, a fuel filter screen 114, an annular filter screen retainer 116, a needle check 118, a needle check tip 120, and a case 122. The cup-shaped case 122 encloses and retains the needle check tip 120, needle check 118, sleeve 112, stop member 80, barrel 44, plunger 60, plunger sleeve 58, plunger spring 62, washer retainer 56, and intensifier piston 34 against the body 20.

The needle check tip 120 communicates to the fuel pumping chamber 82 through at least one but preferably a plurality of fuel discharge passages 124. The needle check 118 and the needle check tip 120 are preferably of the valve-closed-orifice type. One end portion of the needle check tip 120 includes at least one but preferably a plurality of fuel injection spray orifices 104. The needle check spring 108 normally biases the lift spacer 110 and needle check 118 downward so that the needle check 118 is seated against the annular seat 126 of the needle check tip 120. The lift spacer 110 and needle check 118 are moveable to a second position in which the needle check 118 is unseated from the annular seat 126 of the needle check tip 120 allowing fuel to be injected through the fuel injection spray orifices 104. Other details of the nozzle assembly are conventional and form no part of the present invention.

The intensifier piston 34 is moveable between four positions. The first intensifier piston position is when the popper valve 16 is in its first position. That is when the lower seat 18 of the poppet valve 16 is seated against the body 20. In this position the plunger spring 62 is biasing the intensifier piston 34 upward against the seat 52 of the body. In this position the plunger is also biased upward and the plunger second end portion 96 is in contact with the intensifier piston 34. Also in this position the plunger stop 98 is biased upward against the first end portion of the plunger sleeve 86 which in turn biases the plunger sleeve stop 92 against the barrel shoulder 72.

The second, third, and fourth intensifier piston positions occur when the stator assembly 14 is electrically energized so that the poppet valve 16 moves axially upward (according to the orientation shown in FIG. 1) towards its second position unseating the poppet valve from the body 20. In this popper valve position, high pressure actuating fluid is allowed to act upon the intensifier piston 34 urging it axially downward (according to the direction shown in FIG. 1).

The second intensifier piston position occurs during the stroke when the intensifier piston first stop 48 is disengaged from its seat 52 of the body 20 but the intensifier piston second stop 50 has not yet come in contact with the barrel seat 84. When the intensifier piston 34 moves downward, it moves the plunger 60 in a direction toward the fuel pumping chamber 82 exerting pressure on the fuel in the pumping chamber 82. This movement results in an initial fuel flow rate through the spray orifices, 104 to the combustion chamber of the internal combustion engine, providing the force acting on the top of the intensifier piston 34 is sufficient to overcome the fuel pressure within the fuel pumping chamber 82 and providing the fuel pressure in the fuel pump chamber is sufficient to move the needle check valve 118 upward off its seat 126. In the second intensifier piston position, the plunger stop 98 is axially spaced from the plunger sleeve first end portion 86 and the washer retainer lower surface 102 is axially spaced from the plunger sleeve second end portion 88.

In the third intensifier piston position, the intensifier piston first stop 48 is disengaged from the seat 52 on the body 20 but the intensifier piston second stop 50 has not yet come in contact with the barrel seat 84; however, the lower surface of the washer retainer 102 is in contact with the second end portion of the plunger sleeve 88. In the third intensifier piston position the plunger sleeve stop 92 is axially spaced from barrel shoulder 72. As the intensifier piston 34 moves from the second position to the third position, the lower surface of the washer retainer 102 engages the plunger sleeve 58 and both the plunger 60 and the plunger sleeve 58 move in a direction toward the fuel pumping chamber 82 exerting an increased force on the fuel in the pumping chamber. This movement results in an increased fuel flow to the combustion chamber provided the hydraulic force acting on the top surface of the intensifier piston 34 is higher than the force generated by the fuel pressure within the fuel pumping chamber 82 acting on the area $A_3$. When a force balance equilibrium is reached between the fuel pressure in the fuel pumping chamber 82 acting on the area $A_3$ and the force acting on the top of the intensifier piston 34, the downward motion of the plunger 60 and plunger sleeve 58 will stop. The increased diameter $D_3$, results in an equilibrium condition being met earlier in the piston stroke than would be achieved with movement only of the plunger diameter $D_2$. When equilibrium is reached, the fuel flow rate through the spray orifices 104 associated with this fuel pressure will be maintained until the actuating pressure acting on the intensifier piston 34 is either increased or decreased, allowing for additional movement of the intensifier piston In the fourth intensifier piston position the intensifier piston second stop 50 is in contact with the barrel seat 84. As shown in FIGS. 2 and 3, a selected axial clearance $C_2$ is provided between the barrel seat 84 and the second stop 50 of the intensifier piston 34 in order to determine the maximum displacement or stroke of the intensifier piston 34. At the fourth intensifier piston position, the plunger 60 and the plunger sleeve 58 are at their lowest most position.

Retraction of the plunger 60 and the plunger sleeve 58 is accomplished by electrically deenergizing the stator 14. The biasing of the poppet spring 22 returns the poppet valve 16 to its first position removing the hydraulic force acting on the top surface of the intensifier piston 34. With the hydraulic force removed, the biasing force of the plunger spring 62 urges the intensifier piston 34 and the washer retainer 56 upward, which in turn moves the plunger 60 and plunger sleeve 58 upward until the intensifier piston first stop 48 contacts the intensifier piston seat 52.

INDUSTRIAL APPLICABILITY

Unit injectors known in the art utilize a single plunger to compress the fuel in the pumping chamber prior to injection into the combustion chamber of an internal combustion engine. An example of a mechanical unit fuel injector is shown in U.S. Pat. No. 4,327,694 issued to Henson et al. on May 4, 1982. Examples of hydraulically-actuated electronically controlled unit injectors are shown in U.S. Pat. No. 3,689,205 issued to Links on Sep. 5, 1972 and U.S. Pat. No. 5,271,371 issued to Meints et al. on Dec. 21, 1993. In each of these patents, a single plunger is used to pressurize the fuel in the pumping chamber prior to injection. This technique results in a fuel flow rate early in the combustion cycle higher than that required to maintain combustion. For small engines, this is particularly noticeable at idle or low power engine operation and can result in harsh combustion and high exhaust emissions.

The present invention reduces fuel flow in the pre-ignition portion of the engine cycle by shaping the rate of fuel injection early in the combustion cycle. The improvement to the unit injectors described above allows for rate-shaping by control of multiple plungers within the injector. This is accomplished via the movement of the engine cam for a mechanically-acuatated unit injector and through the control of the actuating fluid pressure in the case of the hydraulically-actuated electronically controlled unit injector.

The improvement disclosed in the present invention, although equally applicable to a mechanically-acuatated or a hydraulically-actuated unit injector, is especially significant in the hydraulically-actuated type injectors due to the ability to tune the fuel injection by both the area ratio of the plunger to the plunger sleeve and by the ability to externally control the pressure of the actuating fluid acting on the top surface of the intensifier piston. Unlike a mechanically-actuated unit injector, the rate and timing of injection are not tied to engine speed due to this capability.

Externally controlled rate-shaping results from throttling the actuating fluid pressure acting on the intensifier piston and thereby controlling the downward movement of the plunger sleeve 58 and the plunger 60 toward the fuel pumping chamber 82. By externally controlling the pressure of the actuating fluid, the timing and quantity of the fuel flow injected during pre-injection can be varied.

With relatively low actuating pressure, depending on the area ratio between the intensifier piston and the plunger, fuel injection at a low fuel flow rate can be accomplished early in the injection cycle. With low actuating fluid pressure, movement of the plunger sleeve can be precluded allowing for injection of fuel, by movement of the plunger only, at low fuel flow rates for relatively long periods of time.

With the application of a very high actuating fluid pressure, the opposite scenario is available. If a very high actuating pressure is applied to the top side of the intensifier piston 34 rate shaping can be virtually eliminated. This would be the result of a very rapid movement of the intensifier piston eliminating any significant time delay between the second and fourth intensifier piston positions.

Other aspects, objects and advantages of this invention can be obtained from a study of the drawings, the disclosure and the appended claims.

What we claimed is:

1. A fluid unit injector rate shaping apparatus, comprising:

a housing having a longitudinal bore;

a plunger sleeve having a longitudinal extending bore and being movable within and relative to said housing bore, said housing, said housing bore and said plunger sleeve defining a fluid pump chamber, said plunger sleeve being movable a preselected distance into the pump chamber;

a plunger slidably positioned in said plunger sleeve bore and being movable a preselected distance into the pump chamber, said plunger having an actuating end distally disposed relative to said pump chamber;

first means for moving said plunger in a direction toward the fluid pump chamber, said first means including a moveable member engageable with said actuating end;

second means for moving said plunger sleeve in a direction toward the fluid pump chamber during movement of said plunger.

2. An apparatus as set forth in claim 1, wherein said moveable member comprises an intensifier piston slidably positioned within said housing, said plunger moving in a direction into said pump chamber in response to movement of the intensifier piston.

3. An apparatus as set forth in claim 1, wherein said second means includes an intensifier piston slidably positioned within said housing, said plunger sleeve moving in a direction into the pump chamber in response to movement of the intensifier piston and the plunger a preselected distance toward the pump chamber.

4. A fluid unit injector, according to claim 1, wherein movement of said plunger a first preselected distance in a direction into the pumping chamber initiates a preinjection, and;

movement of said plunger sleeve into the pumping chamber in response to the plunger moving a second preselected distance toward the pump chamber initiates a main injection.

5. An apparatus, as set forth in claim 4, wherein said plunger and plunger sleeve each have a first end portion, said plunger sleeve first end portion and said plunger first end portion having respective first and second diameters wherein said first diameter is greater than the second diameter.

6. In an apparatus for injection rate shaping for a hydraulically-actuated fluid unit injector, said injector having an intensifier piston, a piston cavity, a fuel pump chamber, and means positioned within said piston cavity and said fuel pump chamber and being actuatable by movement of the intensifier piston for exerting pressure on liquid in the fuel pump chamber, the improvement comprising:

said means including a plunger moveable a preselected distance $C_1$ by the intensifier piston in a direction into the fuel pump chamber, and;

a plunger sleeve moveable into the fuel pump chamber in response to the intensifier piston and said plunger moving a preselected distance $C_2$ toward the fuel pump chamber.

7. An apparatus, as set forth in claim 6, wherein said plunger and plunger sleeve each have a first end portion of a preselected area of different magnitudes $A_2$, $A_3$.

8. In an apparatus for injection rate shaping for a hydraulically-actuated fluid unit injector, said injector having a barrel, an intensifier piston, a piston cavity, a plunger spring, a washer retainer, and a ring retainer, said intensifier piston having a first and second end portions, said plunger spring being positioned within said piston cavity and interposed between said washer retainer and said barrel, each of said barrel, said plunger spring, and said washer retainer having a longitudinal central bore, the improvement comprising:

a plunger sleeve having a first end portion, a second end portion, a longitudinal extending bore, and an outwardly extending stop positioned at said first end portion, a preselected length "l" and being slidably positioned and moveable relative to the barrel, the plunger spring and the intensifier piston;

a plunger having first and second end portions, an outwardly extending stop positioned at said first end portion, a diameter of a size suitable for insertion into the bore of said plunger sleeve, and being of a preselected length "L" greater than said plunger sleeve length "l" and being slidably positioned in the bore of said plunger sleeve and moveable relative to the barrel, the plunger sleeve, and the plunger spring; and means of fixedly connecting said second end portion of said plunger to the washer retainer.

9. An apparatus, as set forth in claim 8, wherein said washer retainer and said plunger are moveable between a first position at which the plunger stop is in contact with said plunger sleeve and a second position at which said plunger stop is spaced from said plunger sleeve end portion.

10. An apparatus, as set forth in claim 8, wherein said plunger sleeve and said plunger are moveable relative to the barrel in response to movement of the intensifier piston.

11. An apparatus, as set forth in claim 8, wherein the washer retainer is spaced from the second end portion of the plunger sleeve at the first position of the plunger.

12. An apparatus, as set forth in claim 8, wherein the washer retainer includes a circumferential groove within said bore of said washer retainer, said plunger includes a circumferential groove at the second end portion of said plunger, and said means includes the ring retainer positioned in the groove of each of said washer retainer and plunger.

* * * * *